US007644471B2

(12) United States Patent
Bott et al.

(10) Patent No.: US 7,644,471 B2
(45) Date of Patent: Jan. 12, 2010

(54) VACUUM CLEANER WITH ADJOINING CHAMBER FOR ACCESSORY PIECES

(75) Inventors: Erich Bott, Hollstadt (DE); Roland Illig, Heustreu (DE); Anja Niedergesaess, Ebenhausen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 504 days.

(21) Appl. No.: 10/539,536

(22) PCT Filed: Dec. 5, 2003

(86) PCT No.: PCT/EP03/13784

§ 371 (c)(1),
(2), (4) Date: Jan. 17, 2006

(87) PCT Pub. No.: WO2004/058029

PCT Pub. Date: Jul. 15, 2004

(65) Prior Publication Data

US 2006/0130269 A1 Jun. 22, 2006

(30) Foreign Application Priority Data

Dec. 20, 2002 (DE) ..... 102 60 152

(51) Int. Cl.
*A47L 5/00* (2006.01)
*A47L 9/00* (2006.01)

(52) U.S. Cl. ..... 15/323; 15/327.2

(58) Field of Classification Search ..... 15/323, 15/327.2, 327.7

See application file for complete search history.

(56) References Cited

U.S. PATENT DOCUMENTS

| | | | | | |
|---|---|---|---|---|---|
| 2,779,432 | A | * | 1/1957 | Meyerhoefer | 55/312 |
| 3,619,850 | A | * | 11/1971 | Rideout et al. | 15/323 |
| 3,778,863 | A | | 12/1973 | Westergren et al. | |
| 4,554,700 | A | | 11/1985 | Lyman | |
| 5,168,598 | A | * | 12/1992 | Hashizume et al. | 15/323 |
| 5,644,815 | A | | 7/1997 | Bosyj et al. | |

(Continued)

FOREIGN PATENT DOCUMENTS

DE 1 055 774 4/1959

(Continued)

OTHER PUBLICATIONS

International Search Report for PCT/EP2003/013784.

*Primary Examiner*—Bryan R Muller
(74) *Attorney, Agent, or Firm*—James E. Howard; Andre Pallapies

(57) ABSTRACT

A vacuum cleaner, comprising a housing, in which a dust chamber is embodied for housing a dust separator, which may be sealed by means of a dust chamber lid, mounted on the housing and a housing for accessory pieces which can be closed by the dust chamber lid. According to the invention, the contamination of the accessory pieces by dust from the dust chamber may be prevented, whilst maintaining easy access to the accessory pieces by means of the dust chamber lid, whereby the housing is embodied as an adjoining chamber, directly adjacent to the dust chamber which is separated from the dust chamber in a dust-tight manner by means of a separating wall. The above has the advantage of permitting a user to remove an accessory piece without getting dirty.

10 Claims, 3 Drawing Sheets

U.S. PATENT DOCUMENTS

| | | | | |
|---|---|---|---|---|
| 5,896,617 | A | 4/1999 | Kasen et al. | |
| 5,943,732 | A | 8/1999 | Bosyj et al. | |
| 5,946,768 | A * | 9/1999 | Kelly | 15/315 |
| 6,277,164 | B1 | 8/2001 | Embree et al. | |
| 6,374,452 | B1 | 4/2002 | Essex et al. | |

FOREIGN PATENT DOCUMENTS

| | | | |
|---|---|---|---|
| DE | 28 56 115 | | 7/1980 |
| DE | 88 15 880 | U | 4/1990 |
| EP | 0 299 213 | | 1/1989 |
| EP | 0299213 | A1 * | 1/1989 |
| EP | 1 110 494 | | 6/2001 |
| EP | 1 208 786 | | 5/2002 |
| JP | 04256715 | A1 * | 9/1992 |
| JP | 05-115391 | | 5/1993 |
| JP | 05115391 | A1 * | 5/1993 |
| WO | WO 03/073904 | | 9/2003 |

* cited by examiner 12
15
17
16
9
6
3
7
11
14
4
8
10
5
13
1
2

VACUUM CLEANER WITH ADJOINING CHAMBER FOR ACCESSORY PIECES

The invention relates to a vacuum cleaner.

BACKGROUND OF THE INVENTION

A generic vacuum cleaner is known from U.S. Pat. No. 3,778,863. This vacuum cleaner has a canister formed from a base and a hood. The base and the hood define an internal space in which a tray for implements is arranged. The tray is supported above a receiving space for the filter bag and can be removed therefrom. A seal provided between the base and the hood prevents any dust from escaping from the vacuum cleaner and seals the internal space of the vacuum cleaner such that an underpressure can be built up in the vacuum cleaner by a fan unit. However, a disadvantage with such a vacuum cleaner is that the tray arranged underneath the hood comes in contact with dust-laden air. If the vacuum cleaner is used in operation, the dust can accumulate on the implements held in the tray. If the user takes a required implement from the tray, the user may get dirty when grasping the implements covered with dust.

SUMMARY OF THE INVENTION

It is the object of the invention to further develop a generic vacuum cleaner so as to prevent any contamination of the accessories by dust from the dust chamber and such that the accessories remain easily accessible via a dust chamber lid.

This object is solved according to the invention by the housing for accessory pieces being formed by an adjoining chamber arranged directly adjacent to the dust chamber which is separated from the dust chamber in a dust-tight manner by means of a separating wall. Since the accessory pieces are contained in an adjoining chamber arranged directly adjacent to the dust chamber and is separated therefrom in a dust-tight manner by means of a separating wall, dust is prevented from leaving the dust chamber and contaminating the accessory pieces. This has the advantage that a user can remove an accessory piece without getting dirty.

As a result of the arrangement of the accessory pieces in an adjoining chamber directly adjacent to the dust chamber and as a result of the dust-tight separation by means of a separating wall, the accessory pieces can be stowed in a housing which can be covered by a dust chamber lid. As a result of the construction according to the invention, the advantageous aspect that the accessory pieces are covered visually by the dust chamber lid need not be abandoned. The accessories are still hidden under the dust chamber lid and despite this, no dust can emerge from the dust chamber and contaminate the accessory pieces.

In a preferred embodiment of the invention, the separating wall is formed by a side wall of the adjoining chamber or by a side wall of the dust chamber. Since the adjoining chamber and the dust chamber are arranged adjacent to one another, both chambers are directly accessible when the dust chamber lid is opened. The separating wall arranged between the adjoining chamber and the dust chamber prevents dust from passing over from the dust chamber into the adjoining chamber. The separating wall can thus be simply formed by the side wall of the adjoining chamber facing the dust chamber or by the side wall of the dust chamber facing the adjoining chamber. It is thus possible to have a dust-tight separation of adjoining chamber and dust chamber and at the same time both chambers are easily accessible when the dust chamber lid is opened.

The side wall of a fan compartment can at least partly form a part of the separating wall. This additional feature not only prevents dust from the dust chamber from being able to enter the receiving compartment for the accessories but also prevents dust from the dust chamber from being able to penetrate into the fan compartment. In general, the fan compartment accommodates a fan unit which also comprises an electric motor. For the electric motor and electrical leads leading thereto, it is also advantageous if this is protected against penetration of dust. It is also advantageous if dust is prevented from entering into the fan or into the motor because the lifetime of the fan or motor is thereby increased.

A seal can be arranged between the separating wall and the dust chamber lid for particularly reliable sealing between dust chamber and adjoining chamber or fan compartment. The seal is preferably joined onto or moulded onto an edge of the separating wall facing the dust chamber lid. If the dust chamber lid is closed, the inner surface of the dust chamber lid abuts against the seal and any slight gap between the edge of the separating wall facing the dust chamber lid and the inner surface of the dust chamber lid is reliably sealed. The seal prevents even the finest dust particles from the dust chamber from entering into the adjoining chamber. The seal thus makes it possible to achieve a particularly reliable seal between the dust chamber and the housing compartment for accessories. If the seal is joined detachably to the edge of the separating wall, it can easily be exchanged if required, for example, if it is damaged. A variant which is particularly inexpensive to manufacture provides for moulding the seal directly onto the edge of the separating wall. In the case of plastic parts this can take place by injection moulding using a two-component method wherein a soft-elastic plastic material is moulded onto the upper edge of a separating wall consisting of hard plastic. By directly moulding the seal onto the edge of the separating wall, an additional assembly step to fix the seal to the separating wall is omitted. The number of parts is also reduced as a result of the direct arrangement of the seal on the separating wall.

Alternatively, the seal can be joined or moulded onto the inside of the dust chamber lid and can abut along an edge of the separating wall facing the dust chamber lid when the dust chamber lid is closed. If the seal is not joined or moulded onto an edge of the separating wall but is joined or moulded onto the inside of the dust chamber lid, a particularly reliable fixing of the seal is obtained. Since the seal is now not joined or moulded onto a very small surface such as a narrow edge, but a large-area plane on which the seal can be joined or moulded is available on the inside of the dust chamber lid, a particularly reliable fixing of the seal is achieved.

The seal is preferably embodied as a sealing lip or sealing cord made of an elastomer-like material. Manufacturing the seal from an elastomer-like material favours the sealing properties since relatively large gap dimensions can also be sealed by this sealing material. In the embodiment as a sealing lip it is ensured that the gap between the edge of the separating wall and the inside of the dust chamber lid is reliably closed even if only a coarse manufacturing tolerance is provided as a result of the manufacturing tolerances and as a result of a relatively imprecise pivoting of the dust chamber lid on the housing of the vacuum chamber. If the seal is embodied as a sealing cord, this can be constructed as hose-like with a cavity. A very high elasticity of the seal is thereby achieved whereby large gap dimensions can also be sealed.

In a preferred embodiment of the invention, the dust chamber lid has an opening through which accessory pieces can be removed from the adjoining chamber when the dust chamber lid is closed. Accessory pieces can be removed from the vacuum cleaner through this additional opening in the dust chamber lid when the dust chamber lid is opened or closed. This has the advantage that an accessory piece can also be removed during operation of the vacuum cleaner when dust is sucked into the dust separator in the dust chamber.

The dust chamber lid preferably has a closure part for the opening. The accessory pieces can be covered by the additional closure part so that the overall visual impression of the vacuum cleaner is not disturbed. In addition, a closure part for the opening in the dust chamber lid also prevents objects from outside from being able to fall into the receiving compartment for the accessory pieces and contaminating this receiving compartment.

The closure part can preferably be embodied as a flap pivotally hinged on the dust chamber lid or a blind displaceable in the plane of the dust chamber lid. If the closure part is embodied as a flap pivotally hinged on the dust chamber lid, a particularly inexpensive closure part can be achieved. In the simplest variant a flap made of plastic is moulded directly onto a dust chamber lid made of plastic by means of a film hinge. The embodiment of the closure part as a blind displaceable in the plane of the dust chamber lid has the advantage that the closure part does not project from the external contour of the vacuum cleaner in the open position. The visual appearance of the vacuum cleaner is thus not disturbed even when the closure part is open. In addition, an open blind cannot be damaged to any great extent during operation of the vacuum cleaner as is possible with an open flap.

The invention is explained in detail subsequently with reference to two exemplary embodiments.

DETAILED DESCRIPTION OF THE EXEMPLARY EMBODIMENTS OF THE PRESENT INVENTION

Figure 1:
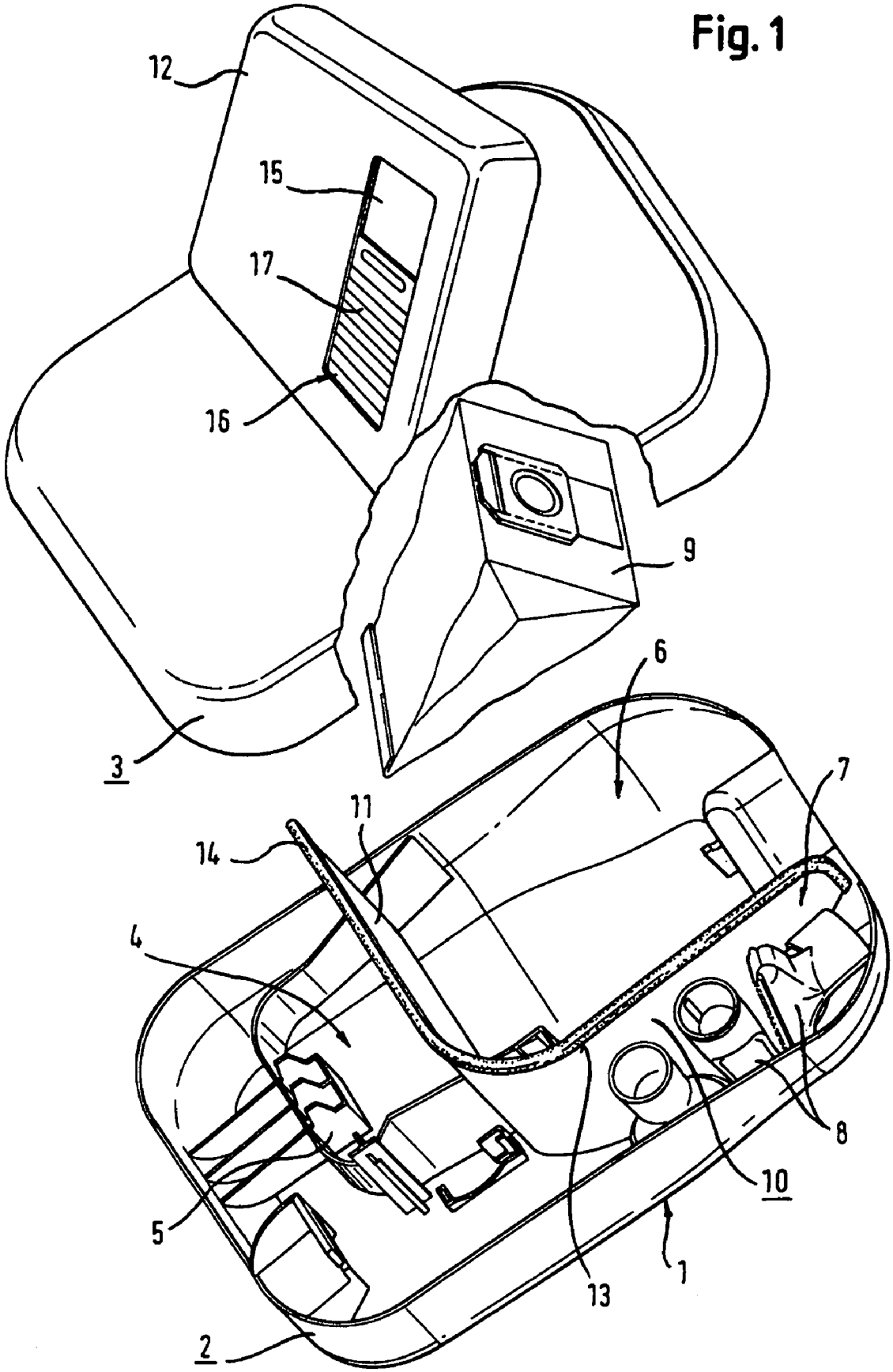
FIG. 1 is a perspective view of an exemplary embodiment of a vacuum cleaner according to the invention.

In the embodiment according to FIG. 1, the vacuum cleaner has a housing 1 comprising a lower section 2 and an upper section 3. A fan compartment 4 is constructed in a rear half of the lower section 2. The fan compartment 4 has retaining means 5 for a fan unit which is not shown. A dust chamber 6 is arranged in the front half of the lower section 2. The dust chamber 6 occupies about two thirds of the width of the lower section 2 of the housing 1. An adjoining chamber 7 is constructed at the side adjacent to the dust chamber 6. The adjoining chamber 7 is used to accommodate various accessory pieces 8. The size of the dust chamber 6 is dimensioned so that it can accommodate a dust separator 9 which is preferably embodied as a dust filter bag or as a cyclone separator. A separating wall 10 runs between the dust chamber 6 and the adjoining chamber 7. The separating wall 10 runs upwards as far as the upper section 3 starting from the inside of the bottom surface of the lower section 2. The separating wall 10 runs from the front end of the vacuum cleaner approximately as far as the centre and then goes over into the side wall 11 aligned perpendicularly to the separating wall 10. The side wall 11 separates the dust chamber 6 from the fan compartment 4. In the exemplary embodiment shown the lower section 2 of the housing 1 is made entirely of plastic. The separating wall 10 and the side wall 11 are made in one piece of plastic and are moulded directly onto the bottom surface and the side walls of the lower section 2.

A dust chamber lid 12 is pivotally mounted on the upper section 3 of the housing 1. The size of the dust chamber lid 12 is dimensioned such that both the dust chamber 6 and the adjoining chamber 7 are accessible when the dust chamber lid 12 is open. A seal 14 is glued to an edge 13 of the separating wall 10 facing the dust chamber lid 12. The seal 14 runs along the entire upper edge 13 of the separating wall 10 or the side wall 11. When the dust chamber lid 12 is closed, the seal 14 abuts against the inner surface of the dust chamber lid 12. In the exemplary embodiment shown in FIG. 1 the dust chamber lid 12 has an opening which is dimensioned such that the accessory pieces 8 can be removed from the adjoining chamber 7 even when the dust chamber lid 12 is closed. The opening 15 in the dust chamber lid 12 can be closed by means of a closure piece which is embodied as a blind 17 displaceable in the plane of the dust chamber lid 12.

Figure 3:
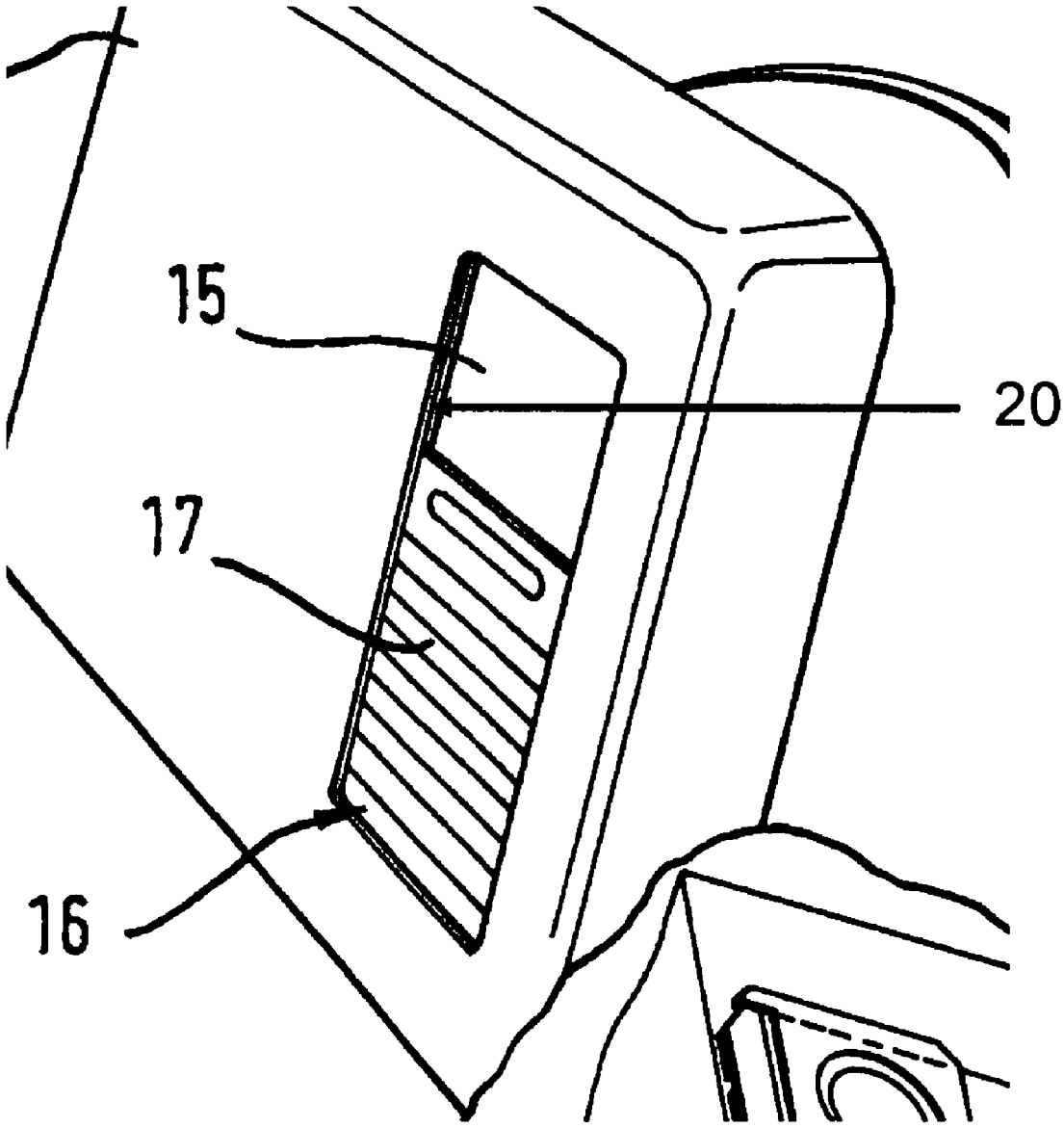
FIG. 3 is a detailed view of the exemplary embodiment of FIG. 1.

As shown in FIGS. 1 and 3, the blind 17 can be displaceable or slidable with respect to the lid along a slide track 20 to open and close the opening 15. The retractable blind 17 is configured such that the blind 17 does not project from the external contour of the vacuum cleaner in the open position.

Figure 2:
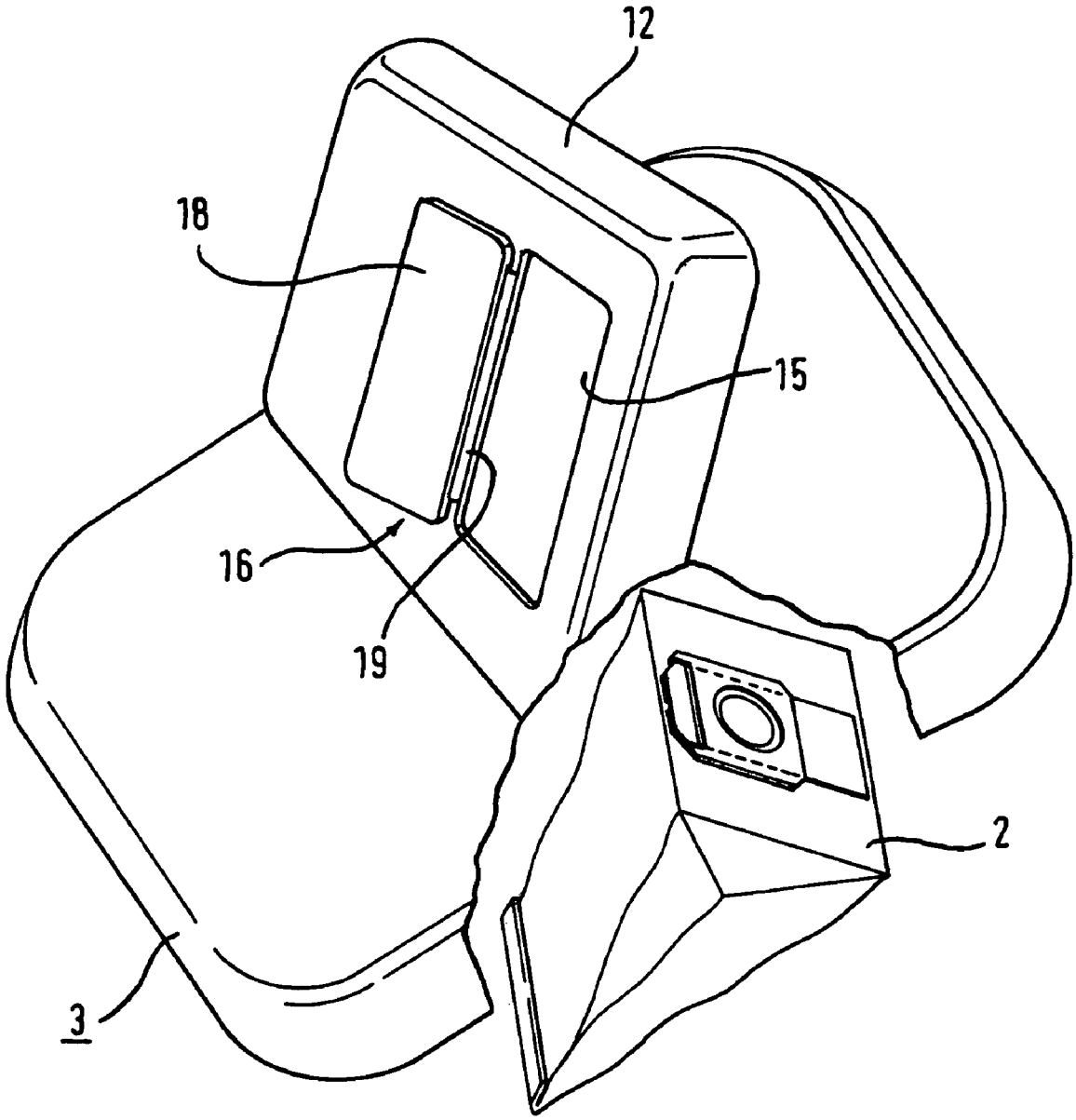
FIG. 2 is a variant of a closure part in the dust chamber lid of the vacuum cleaner from FIG. 1.

Alternatively, the closure part 16 can be embodied as a flap 18 as shown in FIG. 2. The flap 18 is preferably made of plastic and moulded directly onto the dust chamber lid 12 by means of a film hinge 19. Alternatively to this pivotal mounting of the flap 18 on the dust chamber lid 12, instead of a film hinge 19, a hinge constructed as a separate component can be provided which has one side affixed to the dust chamber lid 12 and its other side affixed to the flap 18. The seal 14 on the section of the edge 13 over the side wall 11 preferably lies not on the pivotally mounted dust chamber lid 12 but directly on the upper section 3. However, the dust chamber lid 12 can also be constructed to be so large that the pivot axis of the dust chamber lid 12 lies above the fan compartment 4 and the seal 14 rests on the dust chamber lid 12 both in the area of the edge 13 above the separating wall 10 and also in the area above the side wall 11 when said lid is closed. The opening 15 in the dust chamber lid 12 is preferably dimensioned so that the seal 14 always abuts on the dust chamber lid 12 regardless of whether the closure section 16 is open or closed.

The invention claimed is:

1. A vacuum cleaner comprising:

a housing defining an internal cavity;

a lid connected to the housing for providing access to the internal cavity, the lid being movable between an open condition in which the internal cavity is open, and a closed condition, in which the internal cavity is closed, a wall connected to the housing and defining a dust chamber within the internal cavity, the wall having an edge facing the lid;

a dust separator disposed within the dust chamber for retaining dust;

an accessory chamber disposed within the internal cavity and the wall separating the accessory chamber from the dust chamber; and a seal member forming a dust-tight seal between the wall and the lid when the lid is in the closed condition that prevents dust from passing from the dust chamber into the accessory chamber wherein the lid includes an opening and a closure part for closing the opening, the opening being adjacent to the accessory chamber and providing access to the accessory chamber when the lid is in the closed condition while the seal between the wall and the lid is maintained, a respective portion of the lid borders the opening, this respective portion of the lid defines a lid opening border surface, the closure part includes a retractable blind attached to the lid that is slidable with respect to the lid along a slide track to open and close the opening, and the retractable blind is configured such that the respective portion of the retractable blind that extends along the slide track does not project from an external contour of the vacuum cleaner.

2. The vacuum cleaner according to claim 1, wherein the lid includes:

an opening adjacent to the accessory chamber and providing access to the accessory chamber when the lid is in the closed condition while the seal between the wall and the lid is maintained; and a closure part for closing the opening.

3. The vacuum cleaner according to claim 1, wherein the seal member is connected to the edge of the wall and contacts the lid to form the dust-tight seal when the lid is in the closed condition.

4. The vacuum cleaner according to claim 3, wherein the seal member is removably connected to the edge of the wall.

5. The vacuum cleaner according to claim 3, wherein the seal member is molded onto the edge of the wall.

6. The vacuum cleaner according to claim 1, wherein the seal member is connected to the lid and contacts the edge of the wall to form the dust-tight seal when the lid is in the closed condition.

7. The vacuum cleaner according to claim 1, wherein the seal member includes a deformable elastomeric material.

8. A vacuum cleaner comprising:

a housing defining an internal cavity;

a lid connected to the housing for providing access to the internal cavity, the lid being movable between an open condition in which the internal cavity is open, and a closed condition, in which the internal cavity is closed;

a wall connected to the housing and defining a dust chamber within the internal cavity, the wall having an edge facing the lid;

a dust separator disposed within the dust chamber for retaining dust;

an accessory chamber disposed within the internal cavity and the wall separating the accessory chamber from the dust chamber;

a seal member connected to the edge of the wall and contacting the lid to form a dust-tight seal between the wall and the lid when the lid is in the closed condition that prevents dust from passing from the dust chamber into the accessory chamber, the seal member being formed from a deformable elastomeric material;

an opening defined in the lid adjacent to the accessory chamber and providing access to the accessory chamber when the lid is in the closed condition while the seal between the wall and the lid is maintained, a respective portion of the lid borders the opening and this respective portion of the lid defines a lid opening border surface; and a closure part connected to the lid for closing the opening, the closure part includes a retractable blind attached to the lid that is slidable with respect to the lid along a slide track to open and close the opening, and the retractable blind is configured such that the respective portion of the retractable blind that extends along the slide track does not project from an external contour of the vacuum cleaner.

9. The vacuum cleaner according to claim 8, wherein the seal member is removably connected to the edge of the wall.

10. The vacuum cleaner according to claim 8, wherein the seal member is molded onto the edge of the wall.

* * * * *

UNITED STATES PATENT AND TRADEMARK OFFICE

CERTIFICATE OF CORRECTION

PATENT NO. : 7,644,471 B2
APPLICATION NO. : 10/539536
DATED : January 12, 2010
INVENTOR(S) : Bott et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 850 days.

Signed and Sealed this

Sixteenth Day of November, 2010

David J. Kappos

David J. Kappos
*Director of the United States Patent and Trademark Office*